United States Patent [19]

Simone

[11] 4,207,168

[45] Jun. 10, 1980

[54] TREATMENT OF PYROLYSIS FUEL OIL

[75] Inventor: André A. Simone, Dover, N.J.

[73] Assignee: The Lummus Company, Bloomfield, N.J.

[21] Appl. No.: 922,595

[22] Filed: Jul. 7, 1978

Related U.S. Application Data

[63] Continuation of Ser. No. 825,730, Aug. 18, 1977, abandoned.

[51] Int. Cl.[2] ..... C10G 21/14; C10G 9/14; C09C 1/48

[52] U.S. Cl. ..... 208/86; 208/131; 208/309; 423/450

[58] Field of Search ..... 208/86, 309, 131; 423/450

[56] References Cited

U.S. PATENT DOCUMENTS

| | | | |
|---|---|---|---|
| 3,326,796 | 6/1967 | Muller | 208/50 |
| 3,423,308 | 1/1969 | Murphy | 208/309 |
| 3,687,840 | 8/1972 | Sze et al. | 208/131 |
| 3,817,853 | 6/1974 | Folkins | 208/131 |
| 3,841,865 | 12/1969 | Samuels | 208/309 |
| 3,856,675 | 12/1974 | Sze et al. | 208/10 |
| 3,989,803 | 11/1976 | Henderson | 423/450 |

OTHER PUBLICATIONS

Nelson, "Petroleum Refinery Engineering", 4th Ed., (1958), pp. 85, 774 & 845.

*Primary Examiner*—Herbert Levine
*Attorney, Agent, or Firm*—Louis E. Marn; Elliot M. Olstein

[57] ABSTRACT

A pyrolysis fuel oil (black oil) is contacted with a promoter liquid having a 5 volume percent distillation temperature of at least 250° F. and a 95 volume percent distillation temperature of at least 350° F. and no greater than about 750° F., with the liquid having a characterization factor of at least 9.75 to promote the separation of quinoline insolubles and asphaltenes from the fuel oil. A fraction free of quinoline insolubles and having a reduced content of asphaltenes may be subjected to coking to produce a needle coke, or employed directly for the production of carbon black.

17 Claims, 1 Drawing Figure

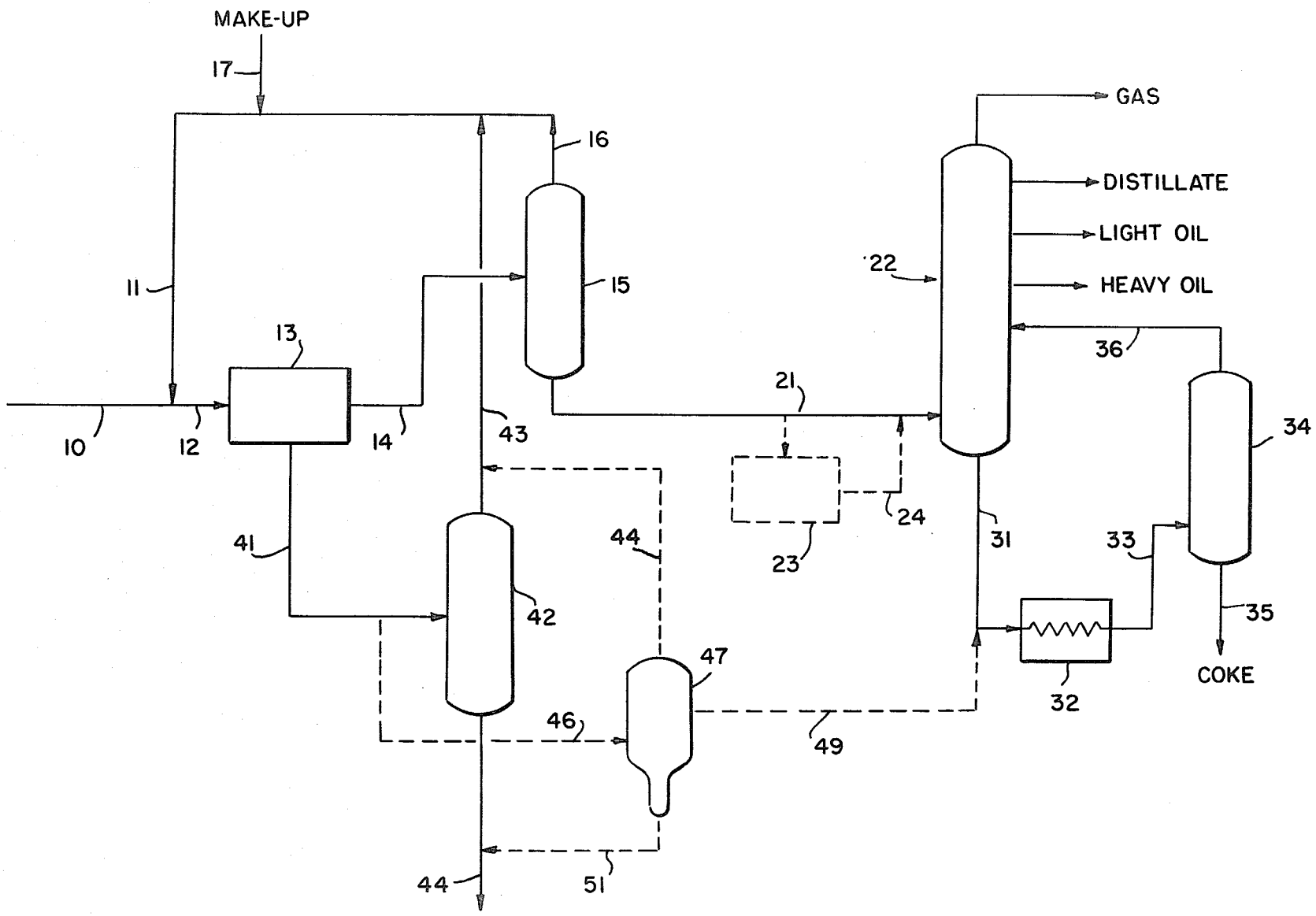
GAS
DISTILLATE
LIGHT OIL
HEAVY OIL
COKE
MAKE-UP
10
11
12
13
14
15
16
17
21
22
23
24
31
32
33
34
35
36
41
42
43
44
46
47
49
51

TREATMENT OF PYROLYSIS FUEL OIL

This is a continuation of application Ser. No. 825,730, filed Aug. 18, 1977, now abandoned.

This invention relates to the treatment of pyrolysis fuel oil and more particularly, to a new and improved process for producing needle coke from a pyrolysis fuel oil (black oil). Needle coke, after calcination and graphitization, is characterized by a low longitudinal coefficient of thermal expansion which is matched by a low electric resistivity and such needle coke is primarily used in producing high quality synthetic graphite electrodes for electrosteel furnaces and for other electrothermal and chlor-alkali industries.

In accordance with the present invention, a pyrolysis fuel oil is contacted with a liquid promoter which promotes and enhances the separation of non-crystalline substances from the oil in order to recover a pyrolysis fuel oil fraction having a reduced quantity of such non-crystalline substances. Such fraction may then be subjected to coking conditions of temperature and pressure to produce a needle coke or be employed directly for the production of carbon black.

The liquid which is employed to enhance and promote the separation of non-crystalline substances is generally a hydrocarbon liquid having a characterization factor (K) of at least about 9.75 and preferably less than 12.0, wherein:

$$K=\sqrt[3]{T_B/G}$$

wherein $T_B$ is the molal average boiling point of the liquid (°R); and G is specific gravity of the liquid (60° F./60° F.).

The characterization factor is an index of the aromaticity/parafinicity of hydrocarbons and petroleum fractions as disclosed by Watson & Nelson Ind. Eng. Chem. 25 880 (1933), with more parafinic materials having higher values for the characterization factory (K). The promoter liquid which is employed is one which has a characterization factor (K) in excess of 9.75.

The following Table provides representative characterization factors (K) for various materials:

TABLE

| | |
|---|---|
| Anthracene | 8.3 |
| Naphthalene | 8.4 |
| 425°-500° F. Coal Tar Distillate | 8.8 |
| 550°-900° F. Coal Tar Distillate | 9.1 |
| 600°-900° F. Coal Tar Distillate | 9.0 |
| 400°-450° F. Coal Tar Distillate | 9.4 |
| Benzene | 9.8 |
| Tetrahydronaphthalene | 9.8 |
| o-xylene | 10.3 |
| Decahydronaphthalene | 10.6 |
| Cyclohexane | 11.0 |
| 425°-500° F. Boiling Range Kerosene | 11.9 |
| n-Dodecylbenzene | 12.0 |
| Propylene Oligomers (pentamer) | 12.2 |
| Cetene | 12.8 |
| Tridecane | 12.8 |
| n-Hexane | 12.9 |
| Hexadecane or cetane | 13.0 |

The liquid which is used to enhance and promote the separation of non-crystalline substances is further characterized by a 5 volume percent distillation temperature of at least about 250° F. and a 95 volume percent distillation temperature of at least about 350° F. and no greater than about 750° F. The promoter liquid preferably has a 5 volume percent distillation temperature of at least about 310° F. and most preferably of at least about 400° F. The 95 volume percent distillation temperature is preferably no greater than about 600° F. The most preferred promoter liquid has a 5 volume percent distillation temperature of at least about 425° F. and a 95 volume percent distillation temperature of no greater than about 500° F. It is to be understood that the promoter liquid may be a hydrocarbon; e.g., tetrahydronaphthalene, in which case the 5 volume percent and 95 volume percent distillation temperatures are the same; i.e., the hydrocarbon has a single boiling point. In such a case, the boiling point of the hydrocarbon must be at least about 350° F. in order to meet the requirement of a 5 volume percent distillation temperature of at least about 250° F. and a 95 volume percent distillation temperature of at least about 350° F. The promoter liquid is preferably a blend or mixture of hydrocarbons in which case the 5 volume percent and 95 volume percent distillation temperatures are not the same.

The 5 volume percent and 95 volume percent distillation temperatures may be conveniently determined by ASTM No. D 86-67 or No. D 1160 with the former being preferred for those liquids having a 95 volume percent distillation temperature below 600° F. and the latter for those above 600° F. The methods for determining such temperatures are well known in the art and further details in this respect are not required for a full understanding of the invention. It is also to be understood that the reported temperatures are corrected to atmospheric pressure.

As representative examples of such liquids, there may be mentioned: kerosene or kerosene fraction from paraffinic or mixed base crude oils; middle distillates, light gas oils and gas oil fractions from paraffinic or mixed based crude oils; alkyl benzenes with side chains containing ten or more carbon atoms; paraffinic hydrocarbons containing more than twelve carbon atoms; white oils or white oil fraction derived from crude oils; alpha-olefins containing more than twelve carbon atoms; fully hydrogenated naphthalenes and substituted naphthalenes; propylene oligomers (pentamer and higher); tetrahydronaphthalene, heavy naphtha fractions, etc. The most preferred liquids are kerosene fractions; white oils; fully hydrogenated naphthalenes and substituted naphthalenes; and tetrahydronaphthalene.

The pyrolysis fuel oil or black oil (the residual heavy black oils boiling above pyrolysis gasolines which are produced as by-products in the steam cracking of virgin petroleum fractions to ethylene) are treated in accordance with the present invention to reduce the aspahaltene content thereof in that such asphaltenes detract from the crystallinity of the needle coke product or the quality of carbon black to be produced therefrom. In treating pyrolysis fuel oils, it is generally not necessary to recover a fraction free of all asphaltenes in that some of the asphaltenes do not detract from the quality of the needle coke or carbon black product to be produced therefrom; accordingly, the promoter liquid can be employed to separate the asphaltenes which are most harmful to needle coke or carbon black quality, without separating all of the asphaltenes. Thus, the promoter liquid is added in an amount sufficient to reduce the asphaltene content of the pyrolysis fuel oil to thereby provide a pyrolysis fuel oil fraction of reduced asphaltene content suitable for the production of needle coke or carbon black. In general, the promoter liquid is employed in an amount to provide a promoter liquid to pyrolysis fuel oil weight ratio of from 0.3:1 to 5:1, and preferably of from 1:1 to 2:1. It is to be understood that the exact ratio will vary with the feedstock and promoter liquid.

Asphaltenes are separated from the pyrolysis fuel oil at a temperature in the order of from 50° C. to about 300° C., and preferably at a temperature of from 100° C. to 200° C. The separation can be effected at atmospheric pressure; however, higher pressures can be employed. The separation may be effected by any one of a wide variety of techniques, with gravity difference separation techniques being preferred, and gravity settling being particularly preferred. In employing gravity settling, a pyrolysis fuel fraction having a reduced content of asphaltenes is recovered as an overflow, and a pyrolysis fuel fraction with an increased content of asphaltenes is recovered as underflow.

In accordance with the present invention, it is possible to recover a pyrolysis fuel oil fraction having an asphaltene content of no greater than 6%, and preferably no greater than 1%, all by weight. In addition, the pyrolysis fuel oil fraction of reduced asphaltene content is generally recovered in a yield of at least 50%, and preferably at least 65%, based on pyrolysis fuel oil feed to the separation operation.

The pyrolysis fuel oil fraction treated in accordance with the present invention also generally includes some small amounts of quinoline insolubles and treatment in accordance with the invention also results in separation of such quinoline insolubles to provide a pyrolysis fuel oil fraction of reduced asphaltene content which is also free of quinoline insolubles.

The recovered treated pyrolysis fuel oil fraction, after separation of promoter liquid therefrom, may then be coked to a needle coke, preferably by a delayed coking technique, although other coking techniques are also possible.

The recovered pyrolysis fuel oil fraction containing an increased content of asphaltenes, after separation of promoter liquid therefrom, may also be coked to produce an anode grade coke. Alternatively, such fraction may be employed for coke oven charge blending, fuel or the like.

In accordance with an embodiment of the present invention, the treated recovered pyrolysis fuel oil fraction, having a reduced quantity of asphaltenes, can be soaked in the presence of sulfur, prior to coking, as described in U.S. Pat. No. 3,687,840.

The invention will be further described with respect to the accompanying drawing, wherein:

The drawing is a simplified schematic flow diagram of an embodiment of the present invention.

It is to be understood, however, that the present invention is not to be limited by the hereinafter described specific embodiment.

Referring now to the drawing, a pyrolysis fuel oil in line 10 is combined with a liquid promoter in line 11 of the type hereinabove described. The combined stream in line 12 is introduced into a separation zone 13 in order to separate a pyrolysis fuel oil fraction of reduced asphaltene content from a pyrolysis fuel oil fraction, of increased asphaltene content. As hereinabove noted, the separation zone 13 is preferably a gravity settling zone, containing one or more gravity settlers, whereby the pyrolysis fuel oil fraction of reduced asphaltene content is recovered as an overflow, with a pyrolysis fuel oil fraction of increased asphaltene content being recovered as an underflow.

The pyrolysis fuel oil fraction of reduced asphaltene content, which contains promoter liquid, is withdrawn from separation zone 13 through line 14 and introduced into a fractionator, schematically indicated at 15, in order to recover the promoter liquid therefrom. An overhead of promoter liquid is withdrawn from fractionator 15 through line 16 combined with make-up in line 17 and recycled through line 11 for mixing with the pyrolysis fuel oil feed.

A pyrolysis fuel oil fraction of reduced asphaltene content is withdrawn from fractionator 15 through line 21 and introduced into a coker combination fractionating tower 22 of a type known in the art.

In accordance with a preferred embodiment, the pyrolysis fuel oil fraction is introduced into a sulfur soaking zone, schematically indicated as 23, as described in U.S. Pat. No. 3,687,840. The pyrolysis fuel oil is withdrawn from soaking zone 23 through line 24 for introduction into the coker combination fractionator 22.

The coker combination fractionating tower 22 is operated as known in the art to recover a gas fraction, a distillate fraction, a light oil fraction, and a heavy oil fraction.

A cokeable bottoms product, having an initial boiling point of 290° to 430° C. is withdrawn from coker combination fractionating tower 22 through line 31 and passed through a coking heater 32 as known in the art wherein the fraction is heated to a temperature in the order of from about 454° C. to about 515° C. The heated fraction in line 33 is introduced into a coking drum 34 wherein the fraction is delayed coked to needle coke. In general, as known in the art, such coking drums are operated at a pressure of from about 1.05 kg/cm$^2$ (g) to about 6.3 kg/cm$^2$ (g), preferably from about 1.8 to 6.3 kg/cm$^2$ (g), and at an overhead temperature of from about 414° C. to about 475° C. and preferably from about 460° C. to about 475° C. The coke is withdrawn from the drum 34 through line 35.

An overhead is withdrawn from the coke drum 34 through line 36, and such overhead is introduced into the coker combination fractionator 22 to recover various fractions therefrom, as known in the art.

A pyrolysis fuel oil fraction, including an increased content of asphaltenes and promoter liquid is withdrawn from separation zone 13 through line 41 and introduced into a fractionator 42 to separate the promoter liquid therefrom. The separated promoter liquid is withdrawn from fractionator 42 as an overhead through line 43 for combination with the recycled promoter liquid in line 11.

A heavy pyrolysis fuel oil fraction is withdrawn from fractionator 42 and may be employed, for example, for the production of anode grade coke.

Alternatively, the heavy pyrolysis fuel oil fraction withdrawn through line 41 may be introduced through line 46 into a flash distillation zone, schematically indicated as 47, to recover the promoter liquid, as overhead through line 48, and a fraction boiling from about 315° C. to about 538° C., as a sidestream through line 49, with the sidestream in line 49 being employed as additional feed for the production of needle coke.

The remaining heavy fraction, withdrawn as bottoms through line 51 may be employed for the production of, for example, anode grade coke.

The invention will be further described with respect to the following example; however, the scope of the invention is not to be limited thereby.

EXAMPLE

A pyrolysis fuel oil (18.2 wt % asphaltenes; 0.09 wt % Quinoline Insolubles) is mixed for 0.5 hr. at a temperature of 134° F. with a promoter liquid having a characterization factor of 11.8, a 5 volume percent distillation temperature of greater than 310° F. and an end point of 425° F. in an amount to provide a promoter liquid to pyrolysis fuel oil wt. ratio of 2.0:1.0.

The mixture is subjected to gravity settling (220° F.; atmospheric pressure; 2.0 hrs) and the promoter liquid free overflow, contains 6.2 wt. % of asphaltenes and 0% quinoline insolubles and is recovered in a yield of 66.6 wt.%, based on pyrolysis fuel oil feed.

The recovered pyrolysis fuel oil fraction of reduced asphaltene content will produce a high grade of needle coke or a superior grade of carbon black.

The present invention is particularly advantageous in that it is possible to produce a high quality needle coke or carbon black in high yields. Thus, for example, high yields of needle coke or carbon black from pyrolysis fuel oil are made possible by the high recovery of non-distillable components having a reduced asphaltene content. Thus, in accordance with the present invention, it is possible to recover in excess of 65% of the non-distillable quinoline soluble components present in the pyrolysis fuel oil, having a reduced content of the asphaltenes which would interfere with the production of crystalline coke to thereby provide a feed suitable for the production of needle coke.

Numerous modifications and variations of the present invention are possible in light of the above teachings and, therefore, within the scope of the appended claims, the invention may be practiced otherwise than as particularly described.

What is claimed is:

1. A process for treating a pyrolysis fuel oil containing asphaltenes, said pyrolysis fuel oil being a heavy residual black oil boiling above pyrolysis gasoline produced as byproduct in the steam cracking of virgin petroleum fractions to ethylene, comprising: contacting said pyrolysis fuel oil with a petroleum fraction liquid promoter which enhances and promotes the separation of asphaltenes from said pyrolysis fuel oil, said liquid promoter having a 5 volume percent distillation temperature of at least about 310° F. and a 95 volume percent distillation temperature of at least about 350° F. and no greater than about 750° F., said liquid having a characterization factor of at least 9.75; and separating by gravity settling a liquid overflow of a pyrolysis fuel oil fraction having a reduced quantity of asphaltene, which is free of quinoline insolubles, from a liquid underflow of a pyrolysis fuel oil fraction having an increased quantity of asphaltene, said underflow and overflow including liquid promoter.

2. The process of claim 1 wherein the promoter liquid is added in an amount to provide a promoter liquid to pyrolysis fuel oil weight ratio of from 0.3:1 to 5:1.

3. The process of claim 2 wherein the promotor liquid has a 95 volume percent distillation temperature of no greater than 600° F.

4. The process of claim 2 wherein the pyrolysis fuel oil fraction recovered in said overflow contains at least 50% of the pyrolysis fuel oil.

5. The process of claim 4 wherein the pyrolysis fuel oil fraction recovered in said overflow has an asphaltene content of no greater than 6%, by weight.

6. The process of claim 2 wherein at least a portion of the pyrolysis fuel oil fraction recovered in said overflow is coked to needle coke.

7. The process of claim 6 wherein said needle coke is produced by delayed coking.

8. The process of claim 7 wherein the pyrolysis fuel oil fraction which is to be coked is heat soaked in the presence of sulfur prior to the coking.

9. The process of claim 7 wherein at least a portion of the pyrolysis fuel oil fraction recovered in said underflow is coked to anode grade coke.

10. The process of claim 6 wherein the promotor liquid has a 95 volume percent distillation temperature of no greater than about 600° F.

11. The process of claim 10 wherein the promotor liquid has a characterization factor of less than 12.0.

12. The process of claim 11 wherein the pyrolysis fuel oil fraction recovered in said overflow contains at least 50% of the pyrolysis fuel oil.

13. The process of claim 12 wherein the pyrolysis fuel oil fraction recovered in said overflow has an asphaltene content of no greater than 6%, by weight.

14. The process of claim 13 wherein the promotor liquid is added in an amount to provide a promotor liquid to pyrolysis fuel oil weight ratio of from 1:1 to 2:1.

15. The process of claim 14 wherein the pyrolysis fuel oil fraction recovered in said overflow has an asphaltene content of no greater than 1%, by weight.

16. The process of claim 13 wherein said gravity settling is effected at a temperature of from 50° C. to 300° C.

17. The process of claim 2 wherein at least a portion of the pyrolysis fuel oil fraction recovered in said overflow is employed for the production of carbon black.

* * * * *